US011873621B2

(12) United States Patent
Kean

(10) Patent No.: US 11,873,621 B2
(45) Date of Patent: Jan. 16, 2024

(54) SYSTEM AND METHOD FOR TRACKING MOTION OF LINKAGES FOR SELF-PROPELLED WORK VEHICLES IN INDEPENDENT COORDINATE FRAMES

(71) Applicant: Deere & Company, Moline, IL (US)

(72) Inventor: Michael G. Kean, Maquoketa, IA (US)

(73) Assignee: Deere & Company, Moline, IL (US)

( * ) Notice: Subject to any disclaimer, the term of this patent is extended or adjusted under 35 U.S.C. 154(b) by 553 days.

(21) Appl. No.: 17/107,059

(22) Filed: Nov. 30, 2020

(65) Prior Publication Data

US 2022/0170239 A1 Jun. 2, 2022

(51) Int. Cl.
*E02F 9/20* (2006.01)
*E02F 3/43* (2006.01)

(52) U.S. Cl.
CPC ..... *E02F 9/2041* (2013.01); *E02F 9/205* (2013.01); *E02F 3/439* (2013.01)

(58) Field of Classification Search
CPC ..... E02F 9/2041; E02F 9/205; E02F 3/439; E02F 3/437; E02F 9/265; E02F 9/264; E02F 9/08; E02F 3/28; E02F 3/36; E02F 3/38; E02F 3/40; E02F 3/42; E02F 9/0866; E02F 9/20; E02F 9/22; E02F 9/26

See application file for complete search history.

(56) References Cited

U.S. PATENT DOCUMENTS

| | | | | |
|---|---|---|---|---|
| 10,401,176 | B2 | 9/2019 | Nackers et al. | |
| 10,532,741 | B2 | 1/2020 | Kean et al. | |
| 10,704,233 | B2 | 7/2020 | Dusha | |
| 10,724,842 | B2 | 7/2020 | Alam | |
| 2017/0191245 | A1* | 7/2017 | Shatters | E02F 3/283 |
| 2018/0373275 | A1* | 12/2018 | Beschorner | G01S 17/86 |
| 2018/0373966 | A1* | 12/2018 | Beschorner | G01C 21/10 |
| 2022/0074168 | A1* | 3/2022 | Yamada | E02F 3/435 |
| 2022/0186459 | A1* | 6/2022 | Igarashi | E02F 9/2228 |

* cited by examiner

*Primary Examiner* — Peter D Nolan
*Assistant Examiner* — Demetra R Smith-Stewart
(74) *Attorney, Agent, or Firm* — Gary L. Montle; Lucian Wayne Beavers; Patterson Intellectual Property Law, PC

(57) ABSTRACT

A system and method are provided for controlling movement of an implement for a self-propelled work vehicle, said implement comprising one or more components coupled to a main frame of the work vehicle. A linkage joint in defined in association with at least one implement component, wherein sensors are respectively associated with opposing sides of the linkage joint. Output signals from each sensor comprise sense elements which are fused in an independent coordinate frame associated at least in part with the respective linkage joint, wherein the independent coordinate frame is independent of a global navigation frame for the work vehicle. At least one joint characteristic (e.g., joint angle) is tracked based on at least a portion of the sense elements from the received output signals for each of the opposing sides of the respective linkage joint. Movement of implement components may optionally be controlled in view of the tracked joint characteristics.

20 Claims, 9 Drawing Sheets

Coordinate Frames

Superimposed Frames

Rotated Frames

SYSTEM AND METHOD FOR TRACKING MOTION OF LINKAGES FOR SELF-PROPELLED WORK VEHICLES IN INDEPENDENT COORDINATE FRAMES

FIELD OF THE DISCLOSURE

The present disclosure relates generally to self-propelled work vehicles such as construction and forestry machines, and more particularly to systems and methods for tracking motion of linkages for self-propelled work vehicles in independent coordinate frames.

BACKGROUND

Self-propelled work vehicles of this type may for example include excavator machines, loaders, crawlers, motor graders, backhoes, forestry machines, front shovel machines, and others. These work vehicles may typically have tracked ground engaging units supporting the undercarriage from the ground surface. These work vehicles may further include a work implement, which includes one or more components, that is used to modify the terrain in coordination with movement of the work vehicle.

There is an ongoing need in the field of such work vehicles for solutions that provide accurate tracking for linkage joint motion of work implement components under dynamic conditions. Conventional algorithms designed to track a roll angle, a pitch angle, and a yaw angle of linkage joint orientation using a sensor system, such as a system of inertial measurement units (IMUs), are a poor solution for work vehicles operating under dynamic conditions. These algorithms involve defining a location of the main frame of the work vehicle in a reference coordinate space, and then calculating the positions of the work implement components based on accelerometer and gyroscopic inputs from sensors mounted on the main frame of the work vehicle and at least one work implement component, such that the roll angle, the pitch angle, or the yaw angle may be determined with respect to a global navigation frame of the work vehicle.

These conventional algorithms may be problematic for a number of reasons. Algorithms which are designed to track roll, pitch, and yaw angles with a system of sensors, such as IMUs, with respect to the global navigation frame of the work vehicle do not account for a combination of kinematics and rigid-body motion in tracking linkage joints. For example, where the main frame of the work vehicle swings about a vertical axis, coupled with a pivoting motion of the at least one work implement component, such movements can reduce the accuracy of the roll, pitch, and yaw angle measurements calculated by the current algorithms. In the context of an excavator, which is an exemplary embodiment of the work vehicle, current algorithms define linkage joint orientation with respect to a horizontal axis aligned with the main frame of the vehicle, rendering it unsuitable for tracking any work implement components, such as a boom, arm, or bucket, which are capable of passing through a vertical axis perpendicular to the horizontal axis aligned with the main frame of the vehicle.

Another drawback associated with the aforementioned algorithms is that a joint angle at the linkage may encompass a combination of the roll, pitch, and yaw angles measured by the IMUs, such that calculating an absolute yaw angle necessitates employing constraint equations to calculate an approximate yaw angle for each IMU associated with the linkage joint. Where the work vehicle is resting on a sloped surface, the measured roll and pitch angles of each IMU associated with the linkage joint may yield differing yaw angles, with respect to the main frame of the work vehicle, due to a three-dimensional nature of the work vehicle positioned on a sloped surface. Such an algorithm necessitates employing constraint equations to calculate an approximate yaw angle for each IMU associated with the linkage joint.

In light of the foregoing limitations in existing algorithms tracking linkage joint motion of work implement components on work vehicles, it would be desirable to track linkage joint motion in connection with any one or more work implement components on work vehicles in an independent coordinate frame, i.e., a coordinate frame which is independent of the main frame of the work vehicle.

BRIEF SUMMARY

The current disclosure provides an enhancement to conventional systems, at least in part by introducing a novel system and method for tracking motion of linkage joints of any two work implement components in an independent coordinate system, by defining the linkage joints of any two work implement components least in part by the linkage joints of the any two work implements in joint space, as opposed to coordinate space dependent in whole, or in part, on a global navigation frame of the work vehicle.

In the context of methods for tracking motion of linkage joints of any two work implement components, certain embodiments of a computer-implemented method are disclosed, such that at least one linkage joint on at least one or more work implement components of the work vehicle are positionally defined. A sensor system, including inertial measurement units (each, an IMU), may be mounted or affixed on opposing sides of the at least one linkage joint, such that the defined at least one linkage joint yields a joint center, coincident to a body of each of the IMUs, the IMUs of which are mounted or affixed on the opposing sides of the at least one linkage joint. With the joint center coincident to the bodies of the IMUs, which are associated with the opposing sides of the at least one linkage joint, motion of the joint center may constitute equivalents on the bodies of the IMUs, with the exception of unconstrained joint degrees of freedom, such as changes in a joint characteristic. In the context of methods for tracking motion of linkage joints of any two work implement components, the at least one joint characteristic may constitute a joint angle of the linkage joint.

In the context of methods for tracking motion of linkage joints of any two work implement components, certain embodiments of a computer-implemented method are disclosed, such that a sensor system including IMUs containing an accelerometer and a gyroscope may be employed to calculate the joint angle of the linkage joint, based upon accelerometer measurements, such as velocity and acceleration, and gyroscope measurements, such as angular velocity and angular acceleration. The joint angle, as determined by the accelerometer measurements and gyroscope measurements, may be fused using a filter with an appropriate selection of gains, so as to track the joint angle for the linkage joint of the any two work implement components.

In the context of methods for tracking motion of linkage joints associated with any one or more work implement components, other embodiments of a computer-implemented method are disclosed, such that a sensor system including IMUs containing a gyroscope may be employed to calculate a joint angle of the linkage joint based upon gyroscope measurements, such as angular velocity and angular acceleration. This may for example be accomplished by taking a dot product and a cross product of the measured angular velocity or angular acceleration so as to calculate the joint angle.

In one particular and exemplary embodiment, a computer-implemented method is provided herein for controlling movement of an implement for a self-propelled work vehicle, said implement having one or more components coupled to a main frame of the work vehicle. At least one linkage joint associated with at least one of the one or more implement components is defined, wherein a plurality of sensors is respectively associated with opposing sides of the at least one linkage joint. Output signals from each of the plurality of sensors are received, said output signals including sense elements. For each of the at least one linkage joint, the sense elements from the received output signals are fused in an independent coordinate frame that is associated at least in part with the respective linkage joint, wherein the independent coordinate frame is independent of a global navigation frame for the work vehicle. For each of the at least one linkage joint, at least one joint characteristic based on at least a portion of the sense elements from the received output signals are tracked for each of the opposing sides of the respective linkage joint.

In one aspect according to the above-referenced embodiment, the computer-implemented method may further comprise directing movement of at least one of the one or more implement components based at least in part on the tracked at least one joint characteristic for a respective linkage joint.

In another embodiment, for each of at least one linkage joint, wherein the sense elements from the received output signals are fused in an independent coordinate frame associated at least in part with the respective linkage joint, a transformation, from a first independent coordinate frame associated with a first sensor on one side of the respective linkage joint with respect to a second independent coordinate frame associated with a second sensor on another side of the respective linkage joint, may be resolved.

In another embodiment, the at least one joint characteristic may comprise a joint angle.

In another embodiment, the implement may comprise a first component having a first end coupled to the main frame at a first linkage joint, and a second component coupled to a second end of the first component at a second linkage joint. For example, the first component or the second component may comprise any one of a boom, an arm, a bell crank, or a working tool, such as a bucket.

In another embodiment, the sense elements may comprise a plurality of acceleration measurements and a plurality of angular velocity measurements.

For each of the at least one linkage joint, wherein at least one joint characteristic based on at least a portion of the sense elements from the received output signals are tracked for each of the opposing sides of the respective linkage joint, the at least one joint characteristic based on at least a portion of the plurality of acceleration measurements and the plurality of angular velocity measurements may be tracked for each of the opposing sides of the respective linkage joint.

In another exemplary aspect further in accordance with the above-referenced embodiment and exemplary aspects, for each of at least one linkage joint, wherein the sense elements from the received output signals are fused in an independent coordinate frame associated at least in part with the respective linkage joint, a filter may be applied to the sense elements of the received output signals, and a gain value may be selected to reduce noise in the sense elements from the received output signals.

In another exemplary aspect further in accordance with the above-referenced embodiment and exemplary aspects, the filter may determine a break frequency for one or more low-frequency measurements based at least in part on the acceleration measurements, and the filter may determine a break frequency for one or more high-frequency measurements based at least in part on the angular velocity measurements.

In another embodiment, the sense elements may constitute a plurality of angular velocity measurements.

For each of the at least one linkage joint, wherein at least one joint characteristic based on at least a portion of the sense elements from the received output signals are tracked for each of the opposing sides of the respective linkage joint, the at least one joint characteristic based on at least a portion of the plurality of angular velocity measurements are tracked for each of the opposing sides of the respective linkage joint.

In another exemplary aspect further in accordance with the above-referenced embodiment and exemplary aspects, for each of at least one linkage joint, wherein the sense elements from the received output signals are fused in an independent coordinate frame associated at least in part with the respective linkage joint, a filter may be applied to the sense elements of the received output signals, and a gain value may be selected to reduce noise in the sense elements from the received output signals.

In another particular and exemplary embodiment, a self-propelled vehicle as disclosed herein may be provided with: an implement, which is configured for working terrain, said implement having one or more components coupled to a main frame of the work vehicle, at least one of the one or more implement components associated with at least one defined linkage joint; a plurality of sensors respectively associated with opposing sides of the at least one linkage joint; and a controller functionally linked to each of the plurality of sensors, said controller configured to receive output signals from each of the plurality of sensors, said output signals comprising sense elements. And, for each of the at least one linkage joint, the controller is configured to: fuse the sense elements from the received output signals in an independent coordinate frame associated at least in part with the respective linkage joint, wherein the independent coordinate frame is independent of a global navigation frame for the work vehicle; and track at least one joint characteristic based on at least a portion of the sense elements from the received output signals for each of the opposing sides of the respective linkage joint.

In another embodiment, the controller may be further configured to direct movement of at least one of the one or more implement components based at least in part on the tracked at least one joint characteristic for a respective linkage joint.

In another embodiment, the controller may be further configured to fuse the sense elements from the received output signals in an independent coordinate frame associated at least in part with the respective linkage joint. This may be accomplished by resolving a transform from a first independent coordinate frame associated with a first sensor on one side of the respective linkage joint with respect to a second independent coordinate frame associated with a second sensor on another side of the respective linkage joint.

In another embodiment, the at least one joint characteristic may comprise a joint angle.

In another embodiment, the implement may comprise a first component having a first end coupled to the main frame at a first linkage joint, and a second component coupled to a second end of the first component at a second linkage joint.

In another embodiment, the sense elements may further comprise a plurality of acceleration measurements and a plurality of angular velocity measurements. The controller may be configured to track the at least one joint characteristic based on at least a portion of the plurality of acceleration measurements and the plurality of angular velocity measurements for each of the opposing sides of the respective linkage joint.

In another exemplary aspect further in accordance with the above-referenced embodiment and exemplary aspects, the controller may be further configured to apply a filter to the sense elements of the received output signals, and the controller may be further configured to select a gain value to reduce noise in the sense elements from the received output signals.

In another exemplary aspect further in accordance with the above-referenced embodiment and exemplary aspects, the controller may determine a break frequency for one or more low-frequency measurements based at least in part on the acceleration measurements, and the controller may determine a break frequency for one or more high frequency measurements based at least in part on the angular velocity measurements.

In another embodiment, the sense elements may constitute a plurality of angular velocity measurements. The controller may be configured to track the at least one joint characteristic based on at least a portion of the plurality of angular velocity measurements for each of the opposing sides of the respective linkage joint.

In another exemplary aspect further in accordance with the above-referenced embodiment and exemplary aspects, the controller may be further configured to apply a filter to the sense elements of the received output signals and select a gain value to reduce noise in the sense elements.

Numerous objects, features, and advantages of the embodiments set forth herein will be readily apparent to those skilled in the art upon reading of the following disclosure when taken in conjunction with the accompanying drawings.

DETAILED DESCRIPTION

Referring now to FIGS. 1-10, various embodiments may now be described of a system and method for tracking motion of linkages for self-propelled work vehicles in independent coordinate frames, said independent coordinate frames independent of a global navigation frame of the work vehicle.

Figure 1:
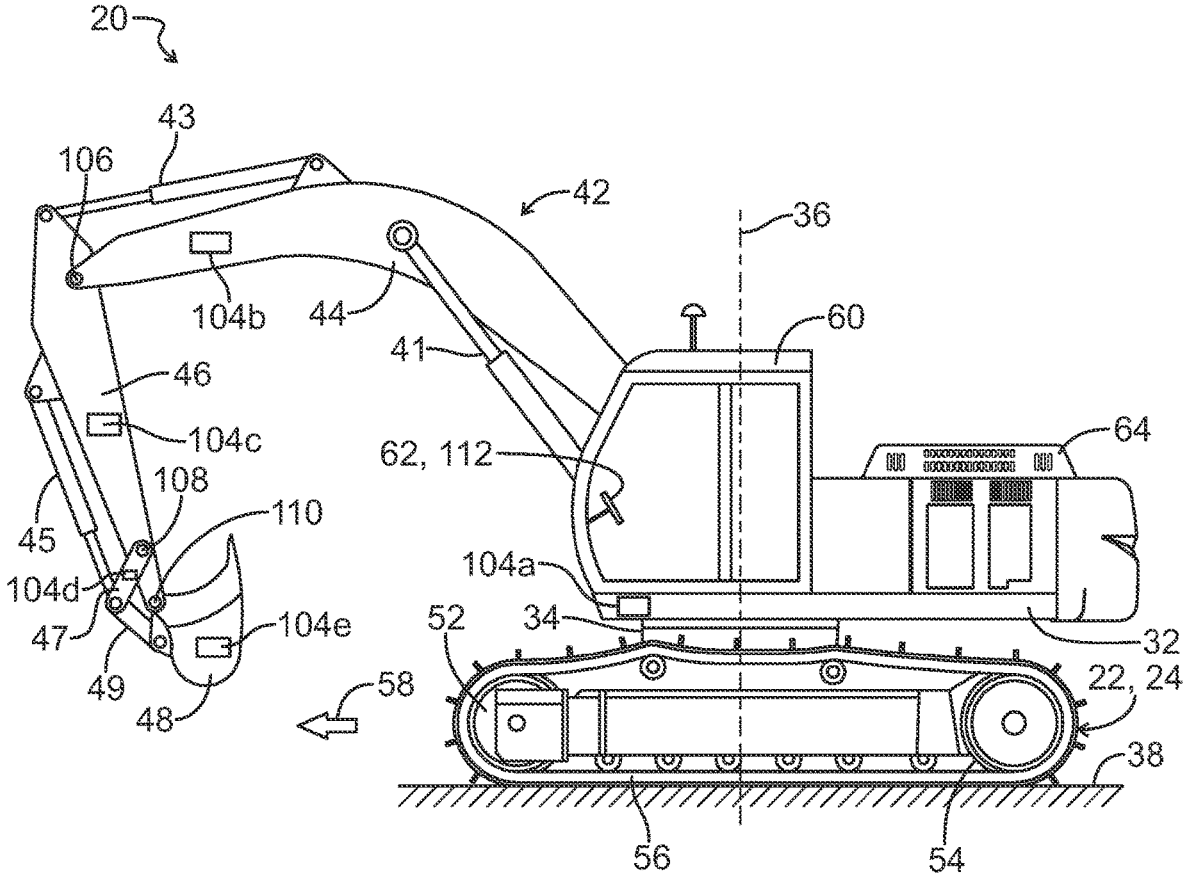
FIG. 1 is a side view representing an excavator as an exemplary self-propelled work vehicle according to an embodiment of the present disclosure.

FIG. 1 depicts a representative self-propelled work vehicle 20 in the form of, for example, a tracked excavator machine 20. The work vehicle 20 includes an undercarriage 22 including first and second ground engaging units 24 including first and second travel motors (not shown) for driving the first and second ground engaging units 24, respectively. A main frame 32 is supported from the undercarriage 22 by a swing bearing 34 such that the main frame 32 is pivotable about a pivot axis 36 relative to the undercarriage 22. The pivot axis 36 is substantially vertical when a ground surface 38 engaged by the ground engaging units 24 is substantially horizontal. A swing motor (not shown) is configured to pivot the main frame 32 on the swing bearing 34 about the pivot axis 36 relative to the undercarriage 22.

A work implement 42 in the context of the referenced work vehicle 20 is a boom assembly 42 having numerous components in the form of a boom 44, an arm 46 pivotally connected to the boom 44 at a linkage joint 106, and a working tool 48. The boom 44 is pivotally attached to the main frame 32 to pivot about a generally horizontal axis relative to the main frame 32. The working tool 48 in this embodiment is an excavator shovel 48, which is pivotally connected to the arm 46 at a linkage joint 110. One end of a dogbone 47 is pivotally connected to the arm 46 at a linkage joint 108, and another end of the dogbone 47 is pivotally connected to a tool link 49. A tool link 49 in the context of the referenced work vehicle 20 is a bucket link 49.

The boom assembly 42 extends from the main frame 32 along a working direction of the boom assembly 42. The working direction can also be described as a working direction of the boom 44. As described herein, control of the work implement 42 may relate to control of any one or more of the associated components (e.g., boom 44, arm 46, tool 48).

A sensor system 104 is mounted on the work vehicle 20, as represented generally including multiple sensors 104*a*, 104*b*, 104*c*, 104*d*, 104*e* respectively mounted to the main frame 32, the boom 44, the arm 46, the dogbone 47, and the tool 48. The sensor system 104 in the context of the referenced work vehicle may constitute a system of inertial measurement units (each, an IMU).

In the embodiment of FIG. 1, the first and second ground engaging units 24 are tracked ground engaging units. Each of the tracked ground engaging units 24 includes a front idler 52, a drive sprocket 54, and a track chain 56 extending around the front idler 52 and the drive sprocket 54. The travel motor of each tracked ground engaging unit 24 drives its respective drive sprocket 54. Each tracked ground engaging unit 24 has a forward traveling direction 58 defined from the drive sprocket 54 toward the front idler 52. The forward traveling direction 58 of the tracked ground engaging units 24 also defines a forward traveling direction 58 of the undercarriage 22 and thus of the working machine 20.

An operator's cab 60 may be located on the main frame 32. The operator's cab 60 and the boom assembly 42 may both be mounted on the main frame 32 so that the operator's cab 60 faces in the working direction 58 of the boom assembly. A control station 62 may be located in the operator's cab 60.

Also mounted on the main frame 32 is an engine 64 for powering the working machine 20. The engine 64 may be a diesel internal combustion engine. The engine 64 may drive a hydraulic pump to provide hydraulic power to the various operating systems of the working machine 20.

Figure 2:
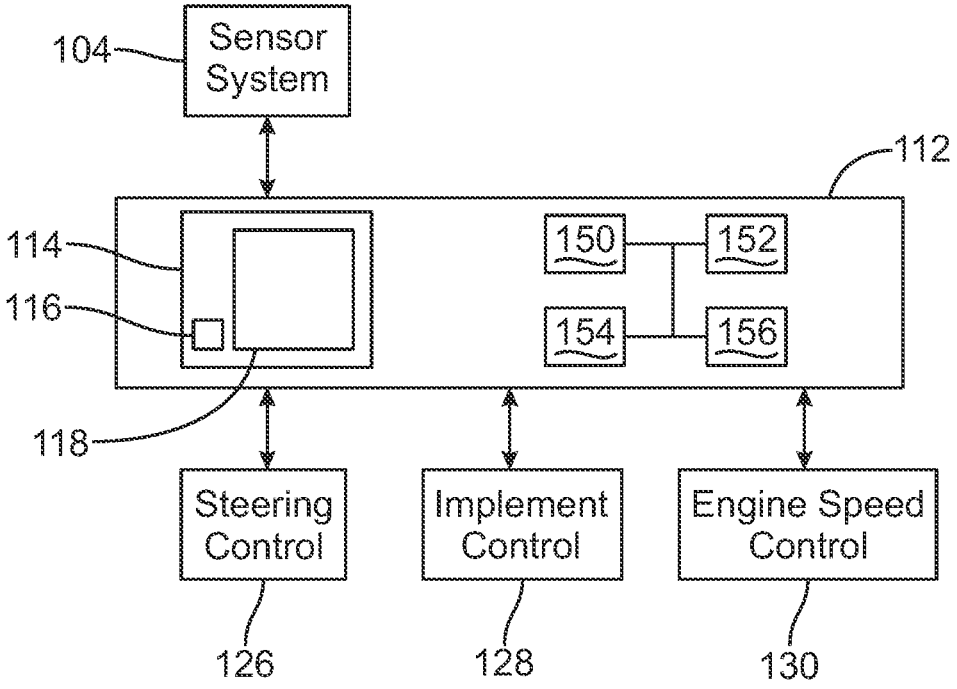
FIG. 2 is a block diagram representing an exemplary control system according to an embodiment of the present disclosure.

As schematically illustrated in FIG. 2, the self-propelled work vehicle 20 includes a control system including a controller 112. The controller may be part of the machine control system of the working machine, or it may be a separate control module. The controller 112 may include a user interface 114 and optionally be mounted in the operator's cab 60 at the control station 62.

The controller 112 is configured to receive input signals from some or all of various sensors collectively defining a sensor system 104, individual examples of which may be described below. Various sensors on the sensor system 104 may typically be discrete in nature, but signals representative of more than one input parameter may be provided from the same sensor, and the sensor system 104 may further refer to signals provided from the machine control system.

The sensor system 104 in the context of the self-propelled vehicle 20 may constitute a system of inertial measurement units (each, an IMU). IMUS are tools that capture a variety of motion- and position-based measurements, including, but not limited to, velocity, acceleration, angular velocity, and angular acceleration.

IMUs include a number of sensors including, but not limited to, accelerometers, which measure (among other things) velocity and acceleration, gyroscopes, which measure (among other things) angular velocity and angular acceleration, and magnetometers, which measure (among other things) strength and direction of a magnetic field. Generally, an accelerometer provides measurements, with respect to (among other things) force due to gravity, while a gyroscope provides measurements, with respect to (among other things) rigid body motion. The magnetometer provides measurements of the strength and the direction of the magnetic field, with respect to (among other things) known internal constants, or with respect to a known, accurately measured magnetic field. The magnetometer provides measurements of a magnetic field to yield information on positional, or angular, orientation of the IMU; similarly to that of the magnetometer, the gyroscope yields information on a positional, or angular, orientation of the IMU. Accordingly, the magnetometer may be used in lieu of the gyroscope, or in combination with the gyroscope, and complementary to the accelerometer, in order to produce local information and coordinates on the position, motion, and orientation of the IMU.

The controller 112 may be configured to produce outputs, as further described below, to the user interface 114 for display to the human operator. The controller 112 may further, or in the alternative, be configured to generate control signals for controlling the operation of respective actuators, or signals for indirect control via intermediate control units, associated with a machine steering control system 126, a machine implement control system 128, and an engine speed control system 130. The controller 112 may, for example, generate control signals for controlling the operation of various actuators, such as hydraulic motors or hydraulic piston-cylinder units 41, 43, 45, and electronic control signals from the controller 112 may actually be received by electro-hydraulic control valves associated with the actuators such that the electro-hydraulic control valves will control the flow of hydraulic fluid to and from the respective hydraulic actuators to control the actuation thereof in response to the control signal from the controller 112.

The controller 112 may include, or be associated with, a processor 150, a computer readable medium 152, a communication unit 154, data storage 156 such as for example a database network, and the aforementioned user interface 114 or control panel 114 having a display 118. An input/output device 116, such as a keyboard, joystick or other user interface tool 116, is provided so that the human operator may input instructions to the controller 112. It is understood that the controller 112 described herein may be a single controller having all of the described functionality, or it may include multiple controllers wherein the described functionality is distributed among the multiple controllers.

Various "computer-implemented" operations, steps or algorithms as described in connection with the controller 112 or alternative but equivalent computing devices or systems can be embodied directly in hardware, in a computer program product such as a software module executed by the processor 150, or in a combination of the two. The computer program product can reside in RAM memory, flash memory, ROM memory, EPROM memory, EEPROM memory, registers, hard disk, a removable disk, or any other form of computer-readable medium 152 known in the art. An exemplary computer-readable medium 152 can be coupled to the processor 150 such that the processor 150 can read information from, and write information to, the memory/storage medium 152. In the alternative, the medium 152 can be integral to the processor 150. The processor 150 and the medium 152 can reside in an application specific integrated circuit (ASIC). The ASIC can reside in a user terminal. In the alternative, the processor 150 and the medium 152 can reside as discrete components in a user terminal.

The term "processor" 150 as used herein may refer to at least general-purpose or specific-purpose processing devices and/or logic as may be understood by one of skill in the art, including but not limited to a microprocessor, a microcontroller, a state machine, and the like. A processor 150 can also be implemented as a combination of computing devices, e.g., a combination of a digital signal processor (DSP) and a microprocessor, a plurality of microprocessors, one or more microprocessors in conjunction with a DSP core, or any other such configuration.

The communication unit 154 may support or provide communications between the controller 112 and external systems or devices, and/or support or provide communication interface with respect to internal components of the self-propelled work vehicle 20. The communications unit 154 may include wireless communication system components (e.g., via cellular modem, WiFi, Bluetooth, or the like) and/or may include one or more wired communications terminals such as universal serial bus ports.

The data storage 156 as further described below may, unless otherwise stated, generally encompass hardware such as volatile or non-volatile storage devices, drives, memory, or other storage media, as well as one or more databases residing thereon.

Figure 3:
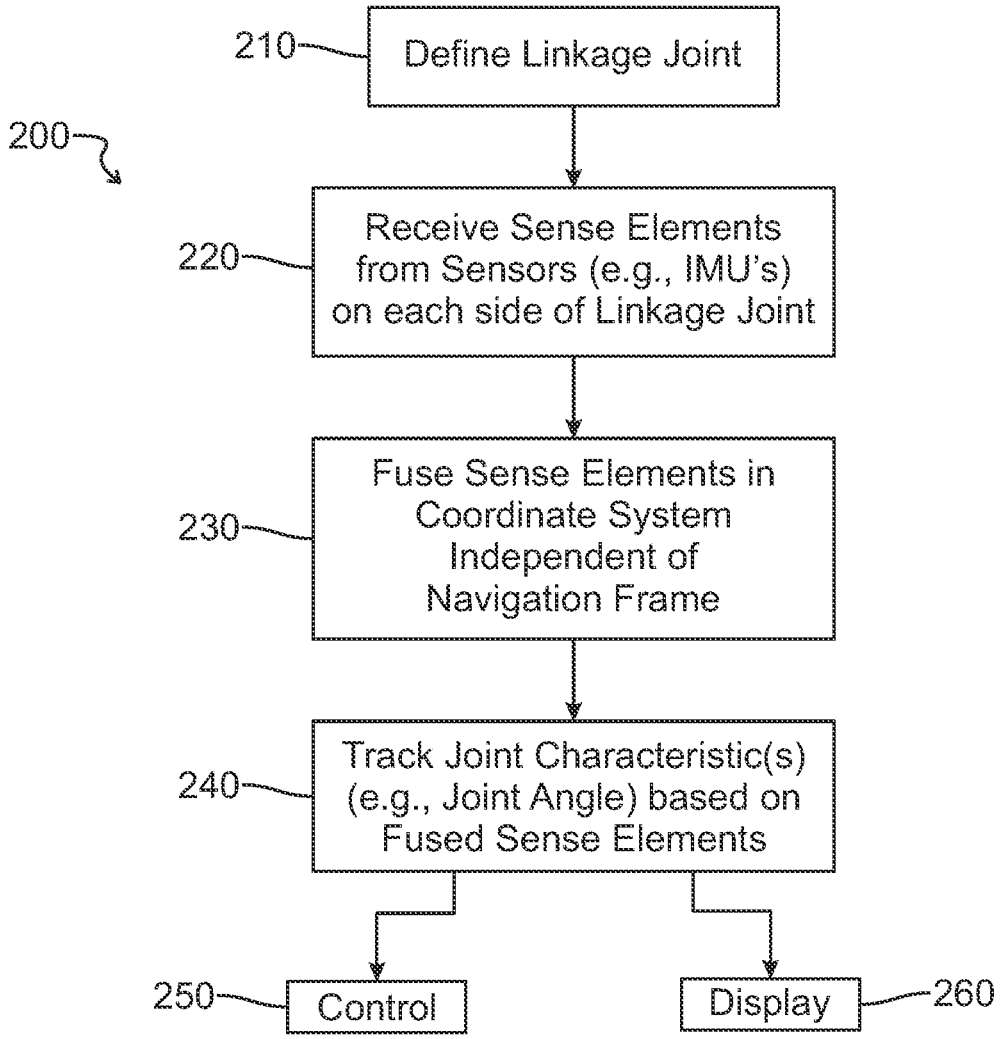
FIG. 3 is a flowchart representing an exemplary embodiment of a method as disclosed herein.
Figure 9:
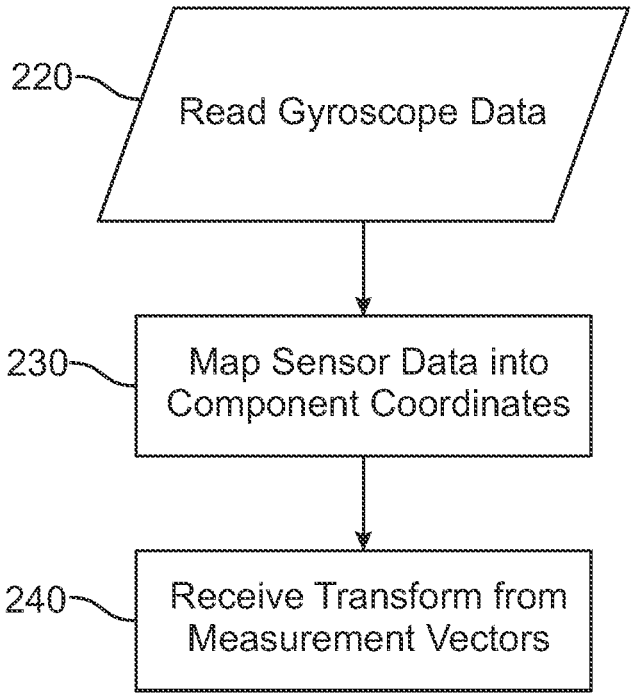
FIG. 9 is a flowchart representing exemplary aspects of another embodiment of a method as disclosed herein.
Figure 10:
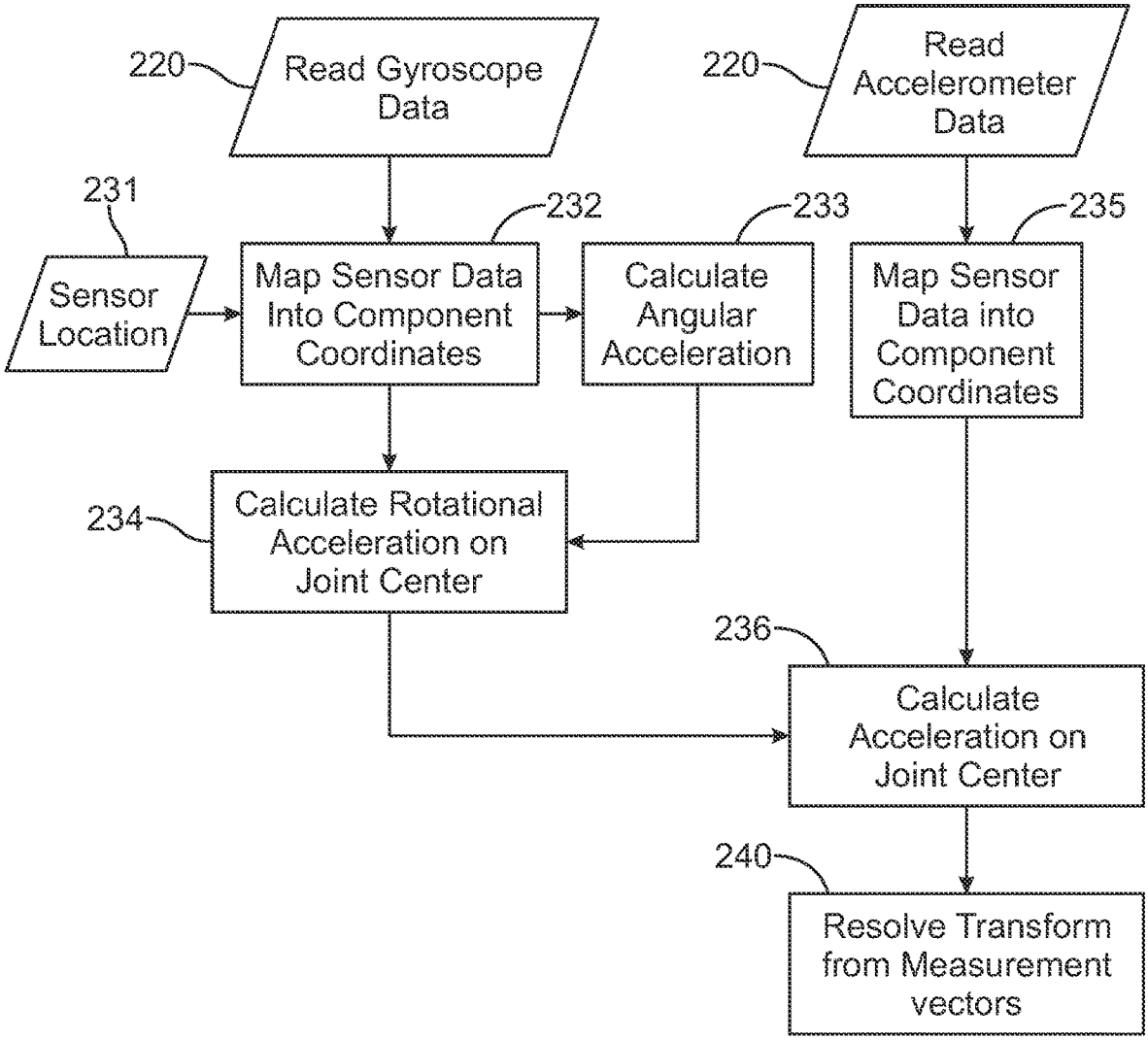
FIG. 10 is a flowchart representing exemplary aspects of another embodiment of a method as disclosed herein.

In FIG. 3, a flowchart representing an exemplary embodiment of a method 200 for tracking motion of linkage joints for a self-propelled work vehicle 20 in independent coordinate frames is depicted. FIG. 9 depicts a flowchart representing exemplary aspects of another embodiment of the method 200 for tracking motion of linkage joints for a self-propelled work vehicle 20 in independent coordinate frames. FIG. 10 depicts a flowchart representing exemplary aspects of an alternative embodiment of the method 200 for tracking motion of linkage joints for a self-propelled work vehicle 20 in independent coordinate frames.

The illustrated method 200 discloses a computer-implemented method of controlling movement of a work implement 42 for a self-propelled work vehicle 20, the work implement 42 of which includes one or more components coupled to a main frame 32 of the work vehicle 20. In the context of the exemplary work implement 42 of the work vehicle 20 depicted in FIG. 1, the one or more components may include a boom 44, an arm 46, and a tool 48.

The method 200 commences with a step 210 of defining at least one linkage joint associated with at least one or more implement components, wherein a plurality of sensors are respectively associated with opposing sides of the at least one linkage joint. The method 200 continues with a step 220 of receiving output signals from each of the plurality of sensors on the opposing sides of the at least one linkage joint, said output signals comprising sense elements. The method 200 continues with a step 230, where for each of the at least one linkages joints defined, the sense elements from the received output signals are fused in an independent coordinate frame associated at least in part with the respective linkage joint, wherein the independent coordinate frame is independent of a global navigation frame for the work vehicle 20. The step 230 continues by tracking at least one joint characteristic based on at a least a portion of the sense elements from the received output signals for each of the opposing sides of the respective linkage joint. The method 200 may optionally continue with a step 250 by automatically controlling or directing movement of the one or more implement components based at least in part on the tracked at least one joint characteristic for the respective linkage joint. Alternatively, or in conjunction with the step 250, the method 200 may continue by a step 260, by generating a display of the tracked at least one joint characteristics for the respective linkage joint.

Returning to FIG. 1 for illustrative purposes, the aforementioned plurality of sensors may comprise a sensor system 104 mounted on or more components of the work vehicle 20. A sensor 104*a* is mounted on the main frame 32; a sensor 104*b* is mounted on the boom 44; a sensor 104*c* is mounted on the arm 46; a sensor 104*d* is mounted on the dogbone 47; and a sensor 104*e* is mounted on the tool 48. In accordance with the step 210, the plurality of sensors may be mounted on opposing sides of the at least one linkage joint. An opposing side of the at least one linkage joint may be ascertained by mounting or affixation of the sensor system 104 on either side of the at least one linkage joint, which is defined as a pivotal linkage joint connecting the one or more components of the work implement 42.

For example, the at least one linkage joint may be defined at a linkage joint 106, which constitutes a pivotal connection of the boom 144 and the arm 46. In this example, the sensor system 104 may be mounted in such a manner that the opposing sides of the at least one linkage joint are defined as follows: the sensor 104*b* mounted on the boom 44 opposing the sensor 104*c* mounted on the arm 46; the sensor 104*b* mounted on the boom 44 opposing the sensor 104*d* mounted on the dogbone 47; or the sensor 104*b* mounted on the boom 44 opposing the sensor 104*e* mounted on the tool 48.

As a further example, the at least one linkage joint may be defined at a linkage joint 108, which constitutes a pivotal connection of the arm 46 to the dogbone 47. In this example, the sensor system 104 may be mounted in such a manner that the opposing sides of the at least one linkage joint are defined as follows: the sensor 104*c* mounted on the arm 46 opposing the sensor 104*d* mounted on the dogbone 47; the sensor 104*c* mounted on the arm 46 opposing the sensor 104*e* mounted on the tool 48; the sensor 104*b* mounted on the boom 44 opposing the sensor 104*d* mounted on the dogbone 47; or the sensor 104*b* mounted on the boom 44 opposing the sensor 104*e* mounted on the tool 48.

As a further example, the at least one linkage joint may be defined at a linkage joint 110, which constitutes a pivotal connection between the arm 46 and the tool 48. In this example, the sensor system 104 may be mounted in such a manner that the opposing sides of the at least one linkage joint are defined as follows: the sensor 104*d* mounted on the dogbone 47 opposing the sensor 104*e* mounted on the tool 48; the sensor 104*c* mounted on the arm 46 opposing the sensor 104*e* mounted on the tool 48; or the sensor 104*b* mounted on the boom 44 opposing the sensor 104*e* mounted on the tool 48.

Under the step 210, the plurality of sensors, such as the sensor system 104, is mounted on opposing sides of the at least one linkage joint. An opposing side of the at least one linkage joint may be ascertained by placement or affixation of the sensor system 104 on either side of the at least one linkage joint, which may be defined as a pivotal linkage joint connecting the one or more components of the work implement 42. In the context of the disclosure of FIG. 1, the at least one linkage joints are depicted as the linkage joint 106, the linkage joint 108, and the linkage joint 110.

Figure 4:
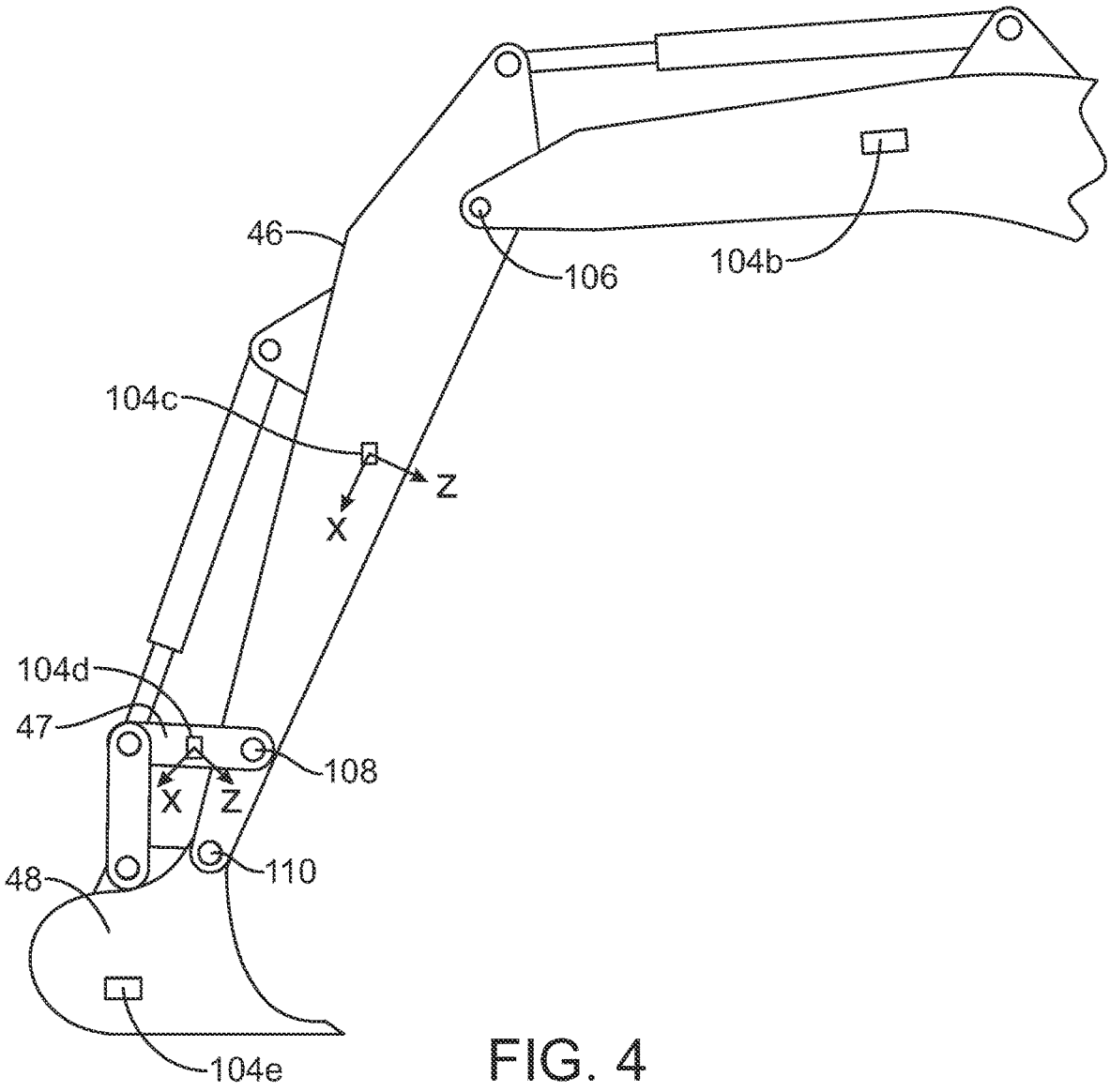
FIG. 4 is a side view representing a boom assembly of the excavator, the boom assembly of which is an exemplary work implement of a self-propelled work vehicle according to an embodiment of the present disclosure.

For example, as depicted in FIG. 4, the at least one linkage joint may be defined at the linkage joint 108, which constitutes a pivotal connection of the arm 46 and the dogbone 47. The sensor system 104 may be mounted in such a manner that the opposing sides of the at least one linkage joint are defined as follows: the sensor 104*c* mounted on the arm 46 opposing the sensor 104*d* mounted on the dogbone 47.

As further set forth in the context of the disclosure in FIG. 4, the step 210 continues by orienting the sensor system 104 in an x-, y-, and z-axis coordinate system. The sensor 104*c* is mounted on the arm 46 and the sensor 104*d* is mounted on the dogbone 47. FIG. 4 discloses a body frame of the sensor 104*c* and a body frame of the sensor 104*d* mounted such that the x-axes of the aforementioned body frames point in the direction along the direction of the work implement 42. FIG. 4 further discloses the body frame of the sensor 104*c* and the body frame of the sensor 104*d* mounted in a manner such that the z-axes of the aforementioned body frames point in the direction of the main frame 32 of the work vehicle 20 (i.e., the excavator 20). Because an x-, y-, and z-axis coordinate system may be defined arbitrarily, the foregoing are not intended as limiting. The x-, y-, and z-axis coordinate system, though may be defined arbitrarily, relates to the mechanical axes of rotation for roll (i.e., rotation about the x-axis), pitch (i.e., rotation about the y-axis), and yaw (i.e., rotation about the z-axis).

Referring again to FIG. 3, the method 200 commences with the step 210 and is followed by the step 220, wherein output signals are received from each of the plurality of sensors, said output signals comprising sense elements. The plurality of sensors (i.e., the sensor system 104), in the context of the self-propelled vehicle 20 disclosed herein, may constitute a system of inertial measurement units (each, an IMU). As previously set forth herein, IMUs are tools that capture a variety of motion- and position-based measurements using a number of sensors including, but not limited to, accelerometers and gyroscopes. IMUs may combine a three-axis accelerometer with a three-axis gyroscope.

An accelerometer is an electro-mechanical device or tool used to measure acceleration ($m/s^2$), which is defined as the rate of change of velocity (m/s) of an object. Accelerometers sense either static forces (e.g., gravity) or dynamic forces of acceleration (e.g., vibration and movement). An accelerometer may receive sense elements measuring the force due to gravity. By measuring the quantity of static acceleration due to gravity of the Earth, an accelerometer may provide data as to the angle the object is tilted with respect to the Earth, the angle of which may be established in an x-, y-, and z-axis coordinate frame. However, where the object is accelerating in a particular direction, such that the acceleration is dynamic (as opposed to static), the accelerometer produces data which does not effectively distinguish the dynamic forces of motion from the force due to gravity by the Earth. A gyroscope is a device used to measure changes in orientation, based upon the object's angular velocity (rad/s) or angular acceleration ($rad/s^2$). A gyroscope may constitute a mechanical gyroscope, a micro-electro-mechanical system (MEMS) gyroscope, a ring laser gyroscope, a fiber-optic gyroscope, and/or other gyroscopes as are known in the art. Principally, a gyroscope is employed to measure changes in angular position of an object in motion, the angular position of which may be established in an x-, y-, and z-axis coordinate frame.

Figure 5A:
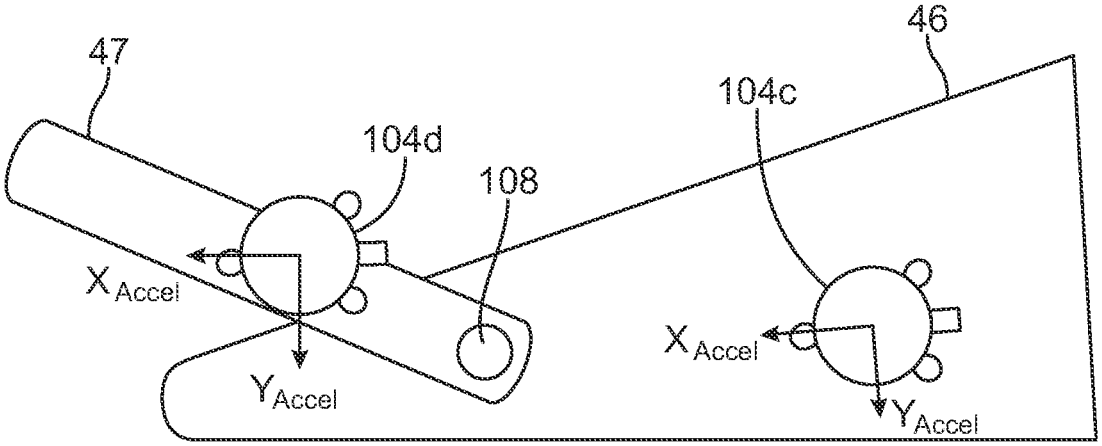
FIGS. 5A-5C are graphical diagrams of the x-, y-, and z-axis coordinates of sensors mounted on work implement components as part of the boom assembly of the excavator.
Figure 5B:
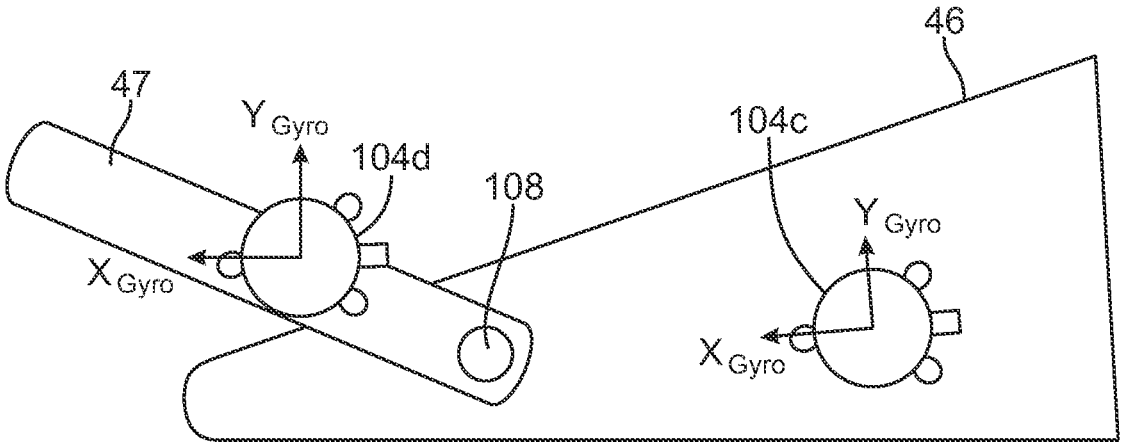
Figure 5C:
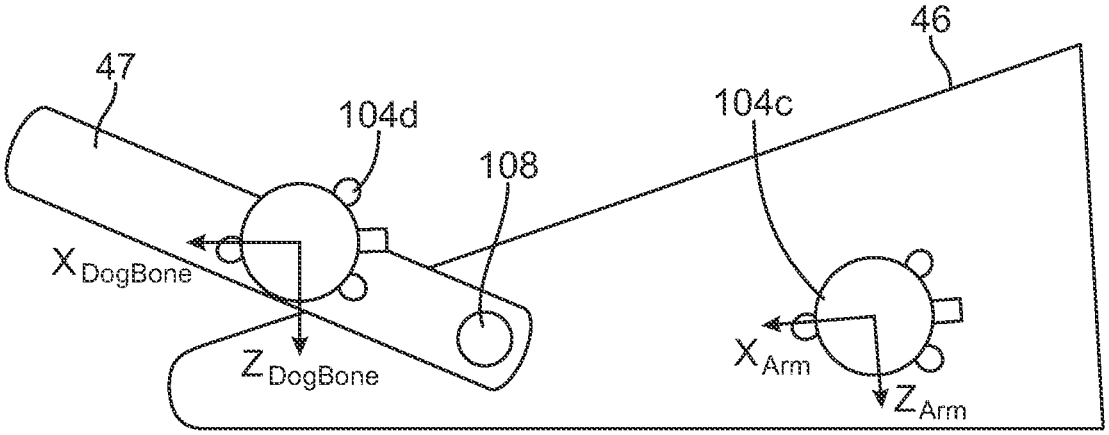

FIGS. 5A-5C depict representative and exemplary graphical diagrams of the x-, y-, and z-axis coordinates of a sensor system mounted on the arm 46 and the dogbone 47 as part of the boom assembly 42 of the excavator 20. The sensor system 104 may be a system of IMUs, each IMU including an accelerometer and/or a gyroscope, and each IMU having a body frame. Under the step 220, sense elements are received by the sensor system 104, which is mounted on the opposing sides of the linkage joint, as depicted in FIGS. 1 and 4, and as previously discussed herein. In FIG. 5A-5B, the sensor 104*c*, which is mounted on the arm 46, includes a gyroscope and an accelerometer; the sensor 104*d*, which is mounted on the dogbone 47, includes a gyroscope and an accelerometer.

As illustrated in FIG. 5A, the accelerometer in the sensor 104*c* and the accelerometer in sensor 104*d* may be positioned such that the x-axes point in the direction along the work implement 42. The accelerometer in the sensor 104*c* and the accelerometer in sensor 104*d* may be positioned such that the y-axes point in the direction of the main frame 32 of the work vehicle 20. For the accelerometer in the sensor 104*c* and the sensor 104*d*, the relationship between the body frame of the aforementioned sensors and the linkage joint 108 may be as follows:

$$\begin{bmatrix} A_X \\ A_Y \\ A_Z \end{bmatrix}_{Body} = \begin{bmatrix} 1 & 0 & 0 \\ 0 & 0 & -1 \\ 0 & 1 & 0 \end{bmatrix} \begin{bmatrix} A_X \\ A_Y \\ A_Z \end{bmatrix}_{IMU}$$

As illustrated in FIG. 5B, the gyroscope in the sensor 104*c* and the gyroscope in the sensor 104*d* may be positioned such that the x-axes point in the direction along the work implement 42. The gyroscope in the sensor 104*c* and the gyroscope in sensor 104*d* may be positioned such that the y-axes point in the direction away from the main frame 32 of the work vehicle 20. For the gyroscope in the sensor 104*c* and the sensor 104*d*, the relationship between the body frame of the aforementioned sensors and the linkage joint 108 may be as follows:

$$\begin{bmatrix} \omega_X \\ \omega_Y \\ \omega_Z \end{bmatrix}_{Body} = \begin{bmatrix} 1 & 0 & 0 \\ 0 & 0 & 1 \\ 0 & -1 & 0 \end{bmatrix} \begin{bmatrix} \omega_X \\ \omega_Y \\ \omega_Z \end{bmatrix}_{IMU}$$

As illustrated in FIG. 5C, a body frame of the sensor 104*c* and a body frame of the sensor 104*d* may be positioned such that the x-axes points in the direction along the work implement 42. The body frame of the sensor 104*c* and the body frame of the sensor 104*d* may be positioned such that z-axes point in the direction of the main frame 32 of the work vehicle 20.

Figure 6A:
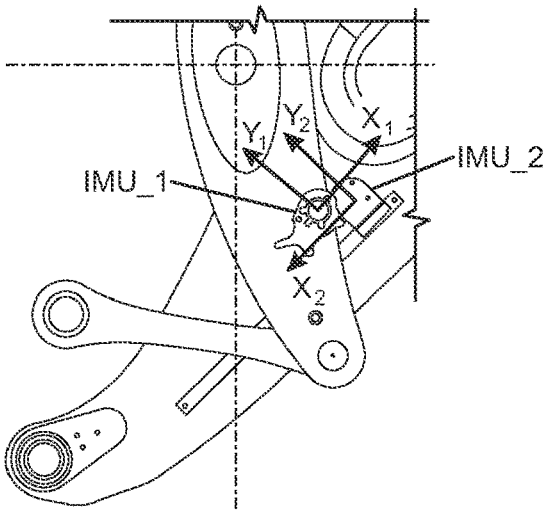
FIGS. 6A-6C are graphical diagrams of the x-, y-, and z-axis coordinates of sensors mounted on work implement components as part of a boom assembly of a loader, the boom assembly of which is an exemplary work implement of a self-propelled work vehicle according to the present disclosure.
Figure 6B:
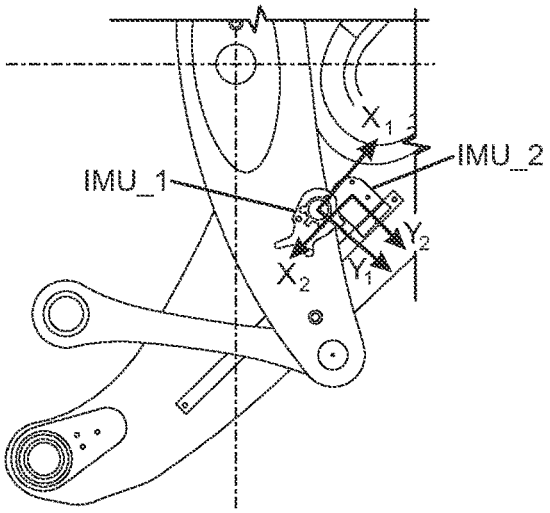
Figure 6C:
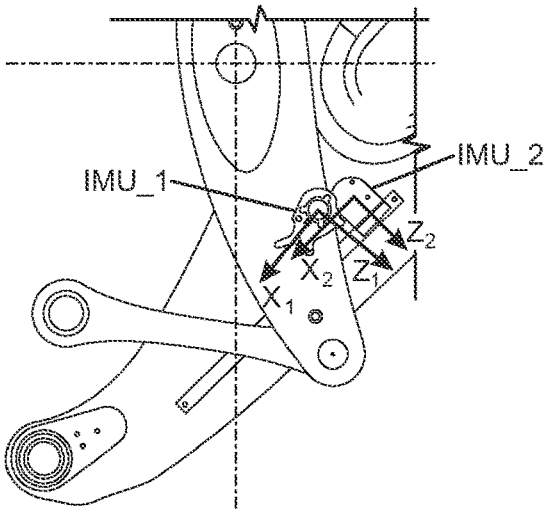

FIGS. 6A-6C depict representative and exemplary graphical diagrams of the x-, y-, and z-axis coordinates of the sensor system 104 mounted on the work implement components as part of a boom assembly of a loader (not separately numbered herein), the boom assembly of which is an exemplary work implement 42 of a self-propelled work vehicle 20 according to the present disclosure. The sensor system 104 may be a system of IMUs, each including an accelerometer and a gyroscope, and each IMU having a body frame.

Under the step 220, the sense elements are received by the sensor system 104 on the opposing sides of the linkage joint. The sense elements from the received output signals may be received by the controller 112, as depicted in FIG. 2, which is functionally linked to the sensor system 104. In FIG. 6A-6C, the sensor system, depicted as IMU_1 and IMU_2 in each of FIGS. 6A, 6B, and 6C, is mounted on a boom assembly of a loader (not numbered herein). The sensor system 104 may be a system of IMUs, each including an accelerometer and a gyroscope, and each IMU having a body frame. In the context of the disclosure set forth in FIGS. 6A-6C, IMU_1 is mounted on a bell crank of the work vehicle 20, and IMU_2 is mounted on a boom of the work vehicle 20. In the context of the disclosure herein, the sensor system 104 (i.e., IMU_1 and IMU_2) includes, but are not limited to, a gyroscope and an accelerometer.

As illustrated in FIG. 6A, the accelerometer in the sensor IMU_1 may be positioned such that the x-axis points away from the direction of a linkage joint (not numbered herein) and along from the direction of a work implement (i.e., boom assembly) of the work vehicle 20. The accelerometer in sensor IMU_2 may be positioned such that the x-axis points in the direction of a linkage joint (not numbered herein) and along the direction of the work implement (i.e., boom assembly) of the work vehicle 20. The accelerometer in the sensor IMU_1 and the sensor IMU_2 may be positioned such that the y-axes point in the direction away from a main frame of the work vehicle 20. For the accelerometer in the sensor IMU_1 and the sensor IMU_2, the relationship between the body frame of the aforementioned sensors and the linkage joint (not numbered herein) may be as follows:

$$\begin{bmatrix} A_X \\ A_Y \\ A_Z \end{bmatrix}_{Body} = \begin{bmatrix} 1 & 0 & 0 \\ 0 & 0 & 1 \\ 0 & -1 & 0 \end{bmatrix} \begin{bmatrix} A_X \\ A_Y \\ A_Z \end{bmatrix}_{BoomIMU}$$

As illustrated in FIG. 6B, the gyroscope in the sensor IMU_1 may be positioned such that the x-axis points away from the direction of a linkage joint (not numbered herein) and along the direction of a work implement (i.e., boom assembly) of the work vehicle 20. The gyroscope in the sensor IMU_2 may be positioned such that the x-axis points in the direction of a linkage joint (not numbered herein) and along the direction of the work implement (i.e., boom assembly) of the work vehicle. The gyroscope in the sensor IMU_1 and the sensor IMU_2 may be positioned such that the y-axes point in the direction of the main frame of the loader (not numbered herein). For the gyroscope in the sensor IMU_1 and the sensor IMU_2, the relationship between the body frame of the aforementioned sensors and the linkage joint (not numbered herein) may be as follows:

$$\begin{bmatrix} \omega_X \\ \omega_Y \\ \omega_Z \end{bmatrix}_{Body} = \begin{bmatrix} 1 & 0 & 0 \\ 0 & 0 & -1 \\ 0 & 1 & 0 \end{bmatrix} \begin{bmatrix} \omega_X \\ \omega_Y \\ \omega_Z \end{bmatrix}_{BoomIMU}$$

As illustrated in FIG. 6C, a body frame of the sensor IMU_1 and a body frame of the sensor IMU_2 may be positioned such that the x-axes of the aforementioned body frames point in the direction of the work implement (i.e., boom assembly) of the work vehicle 20. The body frame of sensor IMU_1 and the body frame of the sensor IMU_2 may be positioned such that the z-axes of the aforementioned body frames point away from the main frame of the work vehicle 20.

Returning again to the represented method 300 of FIG. 3, the step 220 continues with the sensor system 104 receiving the sense elements, which as previously described, may be oriented to match the coordinates of the body frames of the IMUs. The sense elements from the received output signals may be received by the controller 112, as depicted in FIG. 2, which is functionally linked to the sensor system 104.

The exemplary method 200 may continue with the step 230, wherein for each of the at least one linkage joint, the sense elements from the received output signals are fused in an independent coordinate frame associated at least in part with the respective linkage joint, the independent coordinate frame of which is independent of a global navigation frame for the work vehicle. The step 230 discloses an algorithm that merges measurements received by sensor system 104 to produce a desired output in the work implement 42 of the self-propelled vehicle 20.

The step 230 of the algorithm 200 may further include or otherwise proceed with an initialization routine, which initializes bias due with respect to measurements received by the accelerometer and the gyroscope in the sensor system 104. Estimated bias due to the gyroscope may be subtracted from the measured gyroscopic data received by the IMUs, enabling the calculation of angular velocity and angular acceleration. Similarly, estimated bias due to the accelerometer may be subtracted from the measured accelerometer data received by the IMUs, enabling the calculation of velocity and acceleration.

The step 230 of the method 200 may further include the selection of a filtering algorithm with an applicable selection of a gain value, based upon measured noise due from a particular working condition or environment. A filter is necessary to combine low-frequency measurements, such as those received by the accelerometer in the IMUs, with high-frequency measurements, such as those received by gyroscope in the IMUs. There are various filter methods that may be used in connection with the measurements received by the IMUs, including for example a Kalman Filter (KF) and/or a Complementary Filter (CF) as are known in the art.

Figure 7A:
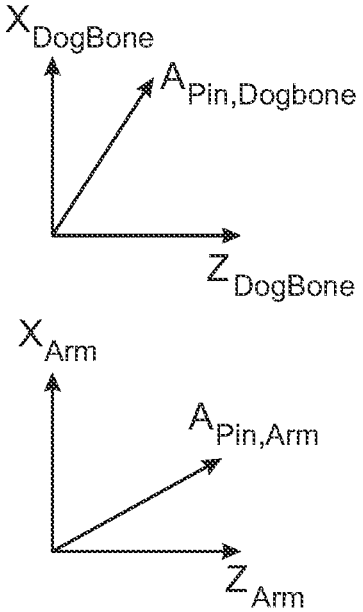
FIGS. 7A-7C are graphical representations of coordinate frames, superimposed frames, and rotated frames for the x-, y-, and z-axis coordinates of sensors mounted on the work implement components as part of the boom assembly of the excavator.
Figure 7B:
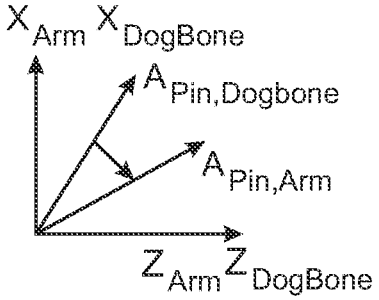

The method 200 may continue as represented with a step 240, wherein at least one joint characteristic, based on at least a portion of the sense elements from the received output signals, are tracked for each of the opposing sides of the linkage joint. The sense elements from the received output signals may be received by the controller 112, as depicted in FIG. 2, which is functionally linked to the sensor system 104, and the controller 112 may be configured to track the at least one joint characteristics. The step 240 may employ linkage kinematics and rigid body motion to determine a pin acceleration of the at least one linkage joint, the pin acceleration of which may yield a joint angle in the independent coordinate frame, which is independent of the global navigation frame for the self-propelled work vehicle 20. Referring to FIGS. 5A-5C, a physical connection, at the linkage joint 108, between the arm 46 and the dogbone 47, limits motion to a single degree of freedom in rotation. In effect, the single degree of freedom may reduce the issue of measuring planar rotation between two sets of axes Referring now to FIGS. 7A-7C, an exemplary vector-based geometrical configuration is depicted of the physical connection at the linkage joint 108 between the arm 46 and the dogbone 47. FIG. 7A demonstrates the x-axis and z-axis of the sensor mounted on the dogbone 47, such that the vector of the pin acceleration is pointed in x-z vector space. FIG. 7A further demonstrates the x-axis and z-axis of the sensor mounted on the arm 46, such that the vector of the pin acceleration is pointed in the x-z vector space. FIG. 7B continues by superimposing the x-axes and z-axes of the sensors mounted on the dogbone 47 and the arm 46, such that the pin acceleration of the dogbone 47 and the pin acceleration of the arm 46 are pointed in the x-z vector space. A difference in the angle due to the vectors of the pin acceleration of the arm 46 and the dogbone 47 is shown as the difference in orientation, where the x-axes and z-axes of the dogbone 47 and the arm 46 are superimposed.

Figure 7C:
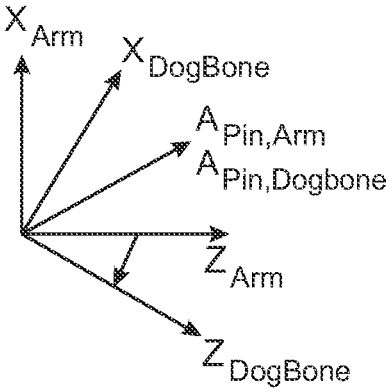

FIG. 7C continues by rotating x-axes of the sensors mounted on the arm 46 and the dogbone 47, such that the pin acceleration of the arm 46 and the dogbone 47 extend in the direction in the x-z vector space. By orienting the pin acceleration of the arm 46 in the same direction as the pin acceleration of the dogbone 47, a difference in the angle between the x-axis of the arm 46 and the x-axis of the dogbone 47 is depicted, and a difference in the angle between the z-axis of the arm 46 and z-axis of the dogbone 47 is depicted.

FIGS. 7A-7C are illustrative of vectors measured for the pin accelerations of the arm 46 and the dogbone 47, all with respect to the linkage joint 108. Accordingly, the coordinate frames of x-, y-, and z-axes of the one or more components of the work implement 42 and the direction of the pin acceleration of said one or more components of the work implement may be ascertained.

Figure 8:
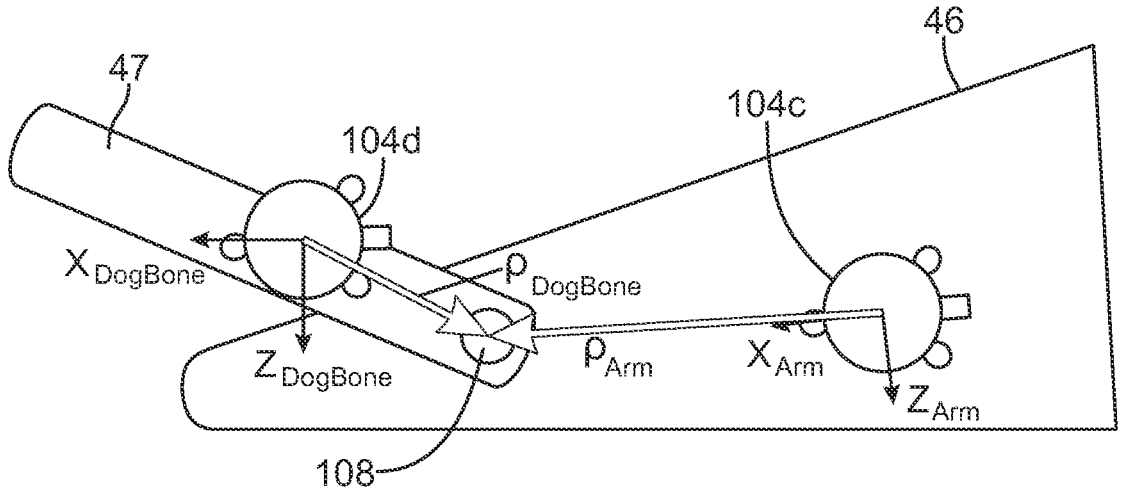
FIG. 8 is a graphical diagram of the x-, y-, and z-axis coordinates of sensors mounted on the work implement components as part of the boom assembly of the excavator, and the direction of vector p calculated from the coordinates of the sensors mounted on the work implement components as part of the boom assembly of the excavator.

Referring next to FIG. 8, a graphical diagram of the x-, y-, and z-axis coordinates of the sensor 104*c*, mounted on the arm 46, and the sensor 104*b*, mounted on the dogbone, is depicted. In FIG. 8, the body frame of the sensor 104*c* and the body frame of the sensor 104*d* may be positioned such that the x-axis points in the direction along the work implement 42. The body frame of the sensor 104*c* and the body frame of the sensor 104*d* may be positioned such that z-axis points in the direction of the main frame 32 of the work vehicle 20.

FIG. 8 further illustrates vectors, as represented by a variable ρ, which are positionally oriented in the direction of a linkage joint. A vector with the variable ρ, depicted as $\rho_{DogBone}$, may extend from the body frame of the sensor 104*d*, mounted on the dogbone 47, in the x-z vector space, such that the vector points to a center of the linkage joint 108. Another vector of the variable ρ, depicted as $\rho_{Arm}$, may also extend from the body frame of the sensor 104*c*, mounted on the arm 46, in the x-z vector space, such that the vector points to a center of the linkage joint 108. The variable ρ may be measured in coordinates of the body frame of the sensor 104*c* and the body frame of the sensor 104*d*. FIG. 8 is illustrative of the variable ρ measured from the body frame of the sensor 104*c*, mounted on the arm 46, and the sensor 104*d*, mounted on the dogbone 47, the variable ρ pointing to the center of the linkage joint 108. Accordingly, the variable ρ, measured from the sensor system 104 in the direction of the at least one linkage joint may be ascertained. The vector ρ, measured from the sensor system 104, may be functionally used to translate the sense elements received from the sensor system of IMUs into equivalent measurements at a joint center of the linkage joint, such as the linkage joint 106, the linkage joint 108, and the linkage joint 110.

Using the variable ρ, at least one joint characteristic, such as the joint angle, may be calculated, evincing a rotation necessary to align acceleration vectors of the sensor 104*d*, mounted on the dogbone 47, and the sensor 104*c*, mounted on the arm 46. FIG. 8 is illustrative of using the variable ρ measured from the body frame of the sensor 104*c*, mounted on the arm 46, and the body frame of the sensor 104*d*, mounted on the dogbone 47, to ascertain the at least one joint characteristic based upon the fused sense elements, said sense elements from received output signals. Accordingly, the variable ρ, may be measured in the direction of the at least one linkage joint, such as the linkage joint 106, the linkage joint 108, and the linkage joint 110, from the sensor system mounted 104 on the opposing sides of the at least one linkage joint.

The method 200 in an embodiment may continue with the step 250, wherein movement of the one or more implement components is controlled or directed based at least in part on the tracked at least one joint characteristic, such as the joint angle, for the respective linkage joint. The controller 112, which may be functionally linked to the sensor system 104, as illustrated in FIG. 2, and may further be configured to automatically control movement of the one or more work implements of the boom assembly 42 of the work vehicle 20. The human operator may effectuate movement or direction of the one or more work implements by or through the user interface tool 116 of the user interface 114. By interacting with the user interface tool 116 of the user interface 114, the controller 112 may be configured to produce an implement control 128 of the one or more work implements of the boom assembly 42 of the work vehicle 20. The controller 112 may, for example, generate control signals for controlling the operation of various actuators, such as hydraulic motors or hydraulic piston-cylinder units 41, 43, and 45, as depicted in FIG. 1.

Alternatively, or in conjunction with the step 250, the method 200 may continue by the step 260, by generating a display of the tracked at least one joint characteristics for the respective linkage joint. The controller 112, which may be functionally linked to the sensor system 104, as illustrated in FIG. 2, may be configured to display the at least one joint characteristic, such as joint angle, for the respective linkage joint. The display 118 of the user interface tool 116 may display to the human operator the at least one joint characteristic, such as joint angle, for the respective linkage joint.

FIG. 9 depicts a flow chart representing exemplary aspects of another embodiment of the method 200 as disclosed herein. According to this embodiment the step 220, wherein sense elements are received from the sensor system 104 on each side of the at least one linkage joint, sense elements from a gyroscope in each of the sensors in the sensor system 104 may be read by the controller 112, which is functionally linked to each of the sensors of the sensor system 104.

In such an embodiment the step 220 may be continued by the step 230, wherein the sense elements from the received output signals are mapped into coordinate space defined by the one or more work components. On opposing sides of the at least one linkage joint, the y-axis of the gyroscopes in the IMUs are aligned to correspond with changes or rotations at a linkage joint. Referring to FIG. 5B, the linkage joint 108 is disclosed, wherein the y-axis of the gyroscope in the sensor 104*c*, mounted on the arm 46, and the y-axis of the gyroscope in the sensor 104*d*, mounted on the dogbone 47, are aligned in the direction away from the main frame 32 of the work vehicle 20. Any motion of the arm 46, relative to the dogbone 47, can be sensed by the controller 112. During a swing, rotation, or articulation of the arm 46 or the dogbone 47, the swing, rotation, or articulation may excite the gyroscopes in the IMUs mounted on the arm 46 and the dogbone 47, such that an angular velocity or angular acceleration measurement sensed in the x-z vector space may be used to calculate the at least one joint characteristic, such as the joint angle, between the arm 46 and the dogbone 47. Any swing, rotation, or articulation of the one or more work implements (e.g., the boom 44, the arm 46, the dogbone 47, and the tool 48) may be utilized to ascertain a direction of angular rotation sensed in the x-z vector space, in order to calculate the at least joint characteristic, such as the joint angle.

Further in accordance with the exemplary technique in FIG. 9, the step 230 may be continued by the step 240, wherein a transformation of the sense elements of received output signals, measured by the gyroscope in each of the sensors in the sensor system 104, is effectuated. A cross product between the angular velocity measurements yields a sine of an interior joint angle, and a dot product between the angular velocity measurements yields a cosine of the interior joint angle. As demonstrated in the embodiment of method 200 in FIG. 9, the at least one joint characteristics, such as joint angle, are determined with respect to sense elements received from the gyroscopes in the sensor system 104.

Referring again to FIG. 5 for illustrative purposes, the step 240 may continue with the step 250, wherein movement of the one or more implement components is controlled or directed based at least in part on the tracked at least one joint characteristic, such as the joint angle, for the respective linkage joint. The controller 112, which may be functionally linked to the sensor system 104, as illustrated in FIG. 2, may be configured to control movement of the one or more work implements of the boom assembly 42 of the work vehicle 20. Alternatively, or in conjunction with the step 250, the method 200 may continue by the step 260, by generating a display of the tracked at least one joint characteristics for the respective linkage joint.

FIG. 10 depicts a flow chart representing exemplary aspects of another embodiment of the method 200 as disclosed herein. Under this embodiment the step 220, wherein sense elements are received from the sensor system 104 on each side of the at least one linkage joint, sense elements from a gyroscope and an accelerometer in each of the sensors in the sensor system 104 may be read by the controller 112, which is functionally linked to each of the sensors of the sensor system 104.

Further in view of the embodiment as represented in FIG. 10, the step 220 may be continued by step 232 and step 235, wherein the sense elements from the received output signals of the gyroscopes and the accelerometers are mapped into coordinate space defined by the one or more work components. Regarding the step 235, at a linkage joint, the y-axis of the accelerometer in the IMU are aligned to correspond with changes or rotations at a linkage joint. In FIG. 5A, the linkage joint 108 is disclosed, wherein the y-axis of the accelerometer in the sensor 104*c*, mounted on the arm 46, and the y-axis of the accelerometer in the sensor 104*d*, mounted on dog bone 47, are aligned in the direction to the main frame 32 of the work vehicle 20. Any motion of the arm 46, relative to the dogbone 47, can be sensed by the controller 112. During a swing, rotation, or articulation of the arm 46 or the dogbone 47, the swing, rotation, or articulation may excite the accelerometers in the IMUs mounted on the arm 46 and the dogbone 47, such that a velocity or acceleration measurement may be used to calculate the at least one joint characteristic, such as the joint angle.

The step 220 may be continued by step 232 and step 235, wherein the sense elements from the received output signals of the gyroscopes and the accelerometers are mapped into coordinate space defined by the one or more work components. Prior to the step 232, a step 231 includes defining opposing sides of an at least one linkage joint. Continuing with the step 232, the y-axis of the gyroscopes in the IMUs are aligned to correspond with changes or rotations at the at least one linkage joint. Rather than comparing the accelerometer-based measurements with respect to the force of gravity, the accelerometer-based measurements are used in connection with measurements from the gyroscopes. In comparing the accelerometer-based measurements with the gyroscope-based measurements, an acceleration of a joint center of the at least one linkage joint may be calculated.

Referring again to FIG. 5B, the linkage joint 108 is disclosed, wherein the y-axis of the gyroscope in the sensor 104*c*, mounted on the arm 46, and the y-axis of the gyroscope in the sensor 104*d*, mounted on the dogbone 47, are aligned in the direction away from the main frame 32 of the work vehicle 20. Any motion of the arm 46, relative to the dogbone 47, can be sensed by the controller 112. During a swing, rotation, or articulation of the arm 46 or the dogbone 47 about the y-axes of the sensor 104*c* and the sensor 104*d*, the swing, rotation, or articulation may excite the gyroscopes in the IMUs mounted on the arm 46 and the dogbone 47, such that an angular velocity or an angular acceleration measurement may be sensed and thereby calculated. In FIG. 10, the method 200 continues with the step 234 by calculating the angular acceleration of a joint center on the at least one linkage joint. Any swing, rotation, or articulation of the one or more work implements may be utilized to ascertain a direction of angular acceleration.

Under the embodiment as disclosed in FIG. 10, the method 200 may further continue with the step 236, wherein for each of the at least one linkage joint, the sense elements from the received output signals, such as the velocity or the acceleration measurements captured by the accelerometer and the angular velocity or angular acceleration measurements captured by the gyroscope, are fused in an independent coordinate frame associated at least in part with the respective linkage joint, such that independent coordinate frame is independent of a global navigation frame for the self-propelled work vehicle 20. The step 236 includes applying a filter, such as a KF or CF, to the sense elements and selecting a gain value to reduce the noise. The controller 112, configured to fuse the sense elements, may determine a break frequency for one or more low-frequency measurements based in part of those measurements due by the accelerometers, and may further determine a break frequency for one or more high-frequency measurements based in part of those measurements due by the gyroscopes.

Under the embodiment as disclosed in FIG. 10, the method 200 may further continue with the step 240 wherein a transformation of the sense elements of received output signals, measured by the gyroscopes and the accelerometers in the sensor system 104, is effectuated using the acceleration measurements and the angular velocity measurements for the joint center of the at least linkage joint.

Referring again to FIG. 5 for illustrative purposes, the step 240 may continue with the step 250, wherein movement of the one or more implement components is controlled or directed based at least in part on the tracked at least one joint characteristic, such as the joint angle, for the respective linkage joint. The controller 112, which may be functionally linked to the sensor system 104, as illustrated in FIG. 2, may be configured to control movement of the one or more work implements of the boom assembly 42 of the work vehicle 20. Alternatively, or in conjunction with the step 250, the method 200 may continue by the step 260, by generating a display of the tracked at least one joint characteristics for the respective linkage joint.

As used herein, the phrase "one or more of," when used with a list of items, means that different combinations of one or more of the items may be used and only one of each item in the list may be needed. For example, "one or more of" item A, item B, and item C may include, for example, without limitation, item A or item A and item B. This example also may include item A, item B, and item C, or item Band item C.

Thus, it is seen that the apparatus and methods of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims. Each disclosed feature or embodiment may be combined with any of the other disclosed features or embodiments.

What is claimed is:

1. A computer-implemented method of controlling movement of an implement for a self-propelled work vehicle, said implement comprising one or more components coupled to a main frame of the work vehicle, the method comprising:

defining at least one linkage joint associated with at least one of the one or more implement components, wherein a plurality of sensors are respectively associated with opposing sides of the at least one linkage joint;

receiving output signals from each of the plurality of sensors, said output signals comprising sense elements;

for each of the at least one linkage joint, fusing the sense elements from the received output signals in an independent coordinate frame associated at least in part with the respective linkage joint, wherein the independent coordinate frame is independent of a global navigation frame for the work vehicle, and tracking at least one joint characteristic based on at least a portion of the sense elements from the received output signals for each of the opposing sides of the respective linkage joint.

2. The method of claim 1, further comprising:

directing movement of at least one of the one or more implement components based at least in part on the tracked at least one joint characteristic for a respective linkage joint.

3. The method of claim 1, wherein:

the step of fusing the sense elements from the received output signals in an independent coordinate frame associated at least in part with the respective linkage joint comprises resolving a transformation from a first independent coordinate frame associated with a first sensor on one side of the respective linkage joint with respect to a second independent coordinate frame associated with a second sensor on another side of the respective linkage joint.

4. The method of claim 1, wherein:

the at least one joint characteristic comprises a joint angle.

5. The method of claim 1, wherein:

the implement comprises a first component having a first end coupled to the main frame at a first linkage joint, and a second component coupled to a second end of the first component at a second linkage joint.

6. The method of claim 1, wherein:

the sense elements comprise a plurality of acceleration measurements and a plurality of angular velocity measurements, and the step of tracking further comprises tracking the at least one joint characteristic based on at least a portion of the plurality of acceleration measurements and the plurality of angular velocity measurements for each of the opposing sides of the respective linkage joint.

7. The method of claim 6, wherein:

the step of fusing further comprises applying a filter to the sense elements of the received output signals, and selecting a gain value to reduce noise in the sense elements from the received output signals.

8. The method of claim 7, wherein:

the filter determines a break frequency for one or more low-frequency measurements based at least in part on the acceleration measurements, and in that the filter determines a break frequency for one or more high-frequency measurements based at least in part on the angular velocity measurements.

9. The method of claim 1, wherein:

the sense elements are a plurality of angular velocity measurements, and the step of tracking further comprises tracking the at least one joint characteristic based on at least a portion of the plurality of angular velocity measurements for each of the opposing sides of the respective linkage joint.

10. The method of claim 9, wherein:

the step of fusing further comprises applying a filter to the sense elements of the received output signals, and selecting a gain value to reduce noise in the sense elements from the received output signals.

11. A self-propelled work vehicle comprising:

an implement configured for working terrain, said implement comprising one or more components coupled to a main frame of the work vehicle, at least one of the one or more implement components associated with at least one defined linkage joint;

a plurality of sensors respectively associated with opposing sides of the at least one linkage joint; and a controller functionally linked to each of the plurality of sensors, and configured to receive output signals from each of the plurality of sensors, said output signals comprising sense elements;

for each of the at least one linkage joint, fuse the sense elements from the received output signals in an independent coordinate frame associated at least in part with the respective linkage joint, wherein the independent coordinate frame is independent of a global navigation frame for the work vehicle, and track at least one joint characteristic based on at least a portion of the sense elements from the received output signals for each of the opposing sides of the respective linkage joint.

12. The self-propelled work vehicle of claim 11, wherein:

the controller is further configured to direct movement of at least one of the one or more implement components based at least in part on the tracked at least one joint characteristic for a respective linkage joint.

13. The self-propelled work vehicle of claim 11, wherein:

the controller is configured to fuse the sense elements from the received output signals in an independent coordinate frame associated at least in part with the respective linkage joint, by resolving a transform from a first independent coordinate frame associated with a first sensor on one side of the respective linkage joint with respect to a second independent coordinate frame associated with a second sensor on another side of the respective linkage joint.

14. The self-propelled work vehicle of claim 11, wherein:

the at least one joint characteristic comprises a joint angle.

15. The self-propelled work vehicle of claim 11, wherein:

the implement comprises a first component having a first end coupled to the main frame at a first linkage joint, and a second component coupled to a second end of the first component at a second linkage joint.

16. The self-propelled work vehicle of claim 11, wherein:

the sense elements comprise a plurality of acceleration measurements and a plurality of angular velocity measurements, and the controller is configured to track the at least one joint characteristic based on at least a portion of the plurality of acceleration measurements and the plurality of angular velocity measurements for each of the opposing sides of the respective linkage joint.

17. The self-propelled work vehicle of claim 16, wherein:

the controller is further configured to apply a filter to the sense elements of the received output signals, and select a gain value to reduce noise in the sense elements from the received output signals.

18. The self-propelled work vehicle of claim 17, wherein:

the controller determines a break frequency for one or more low-frequency measurements based at least in part on the acceleration measurements, and determines a break frequency for one or more high-frequency measurements based at least in part on the angular velocity measurements.

19. The self-propelled work vehicle of claim 11, wherein: the sense elements are a plurality of angular velocity measurements, and the controller is configured to track the at least one joint characteristic based on at least a portion of the plurality of angular velocity measurements for each of the opposing sides of the respective linkage joint.

20. The self-propelled work vehicle of claim 19, wherein: the controller is configured to apply a filter to the sense elements of the received output signals, and select a gain value to reduce noise in the sense elements from the received output signals.

* * * * *